US008139003B2

(12) United States Patent
Inoue et al.

(10) Patent No.: US 8,139,003 B2
(45) **Date of Patent: *Mar. 20, 2012**

(54) DISPLAY DEVICE, VIDEO SIGNAL PROCESSING METHOD, AND PROGRAM

(75) Inventors: Yasuo Inoue, Tokyo (JP); Yoshihiro Kosugi, Tokyo (JP); Ken Kikuchi, Tokyo (JP); Takeya Meguro, Tokyo (JP); Hideto Mori, Kanagawa (JP); Toyo Osumi, Aichi (JP)

(73) Assignee: Sony Corporation, Tokyo (JP)

( * ) Notice: Subject to any disclaimer, the term of this patent is extended or adjusted under 35 U.S.C. 154(b) by 979 days.

This patent is subject to a terminal disclaimer.

(21) Appl. No.: 12/121,469

(22) Filed: May 15, 2008

(65) Prior Publication Data

US 2008/0291136 A1 Nov. 27, 2008

(30) Foreign Application Priority Data

May 18, 2007 (JP) ..... 2007-133227

(51) Int. Cl.
*G09G 3/30* (2006.01)

(52) U.S. Cl. ..... 345/77; 345/691; 345/82; 345/204

(58) Field of Classification Search ..... 345/76–83, 345/204, 207, 690, 691; 315/169.3; 313/463; 348/223.1, 571, E5.062; 382/162, 167
See application file for complete search history.

(56) References Cited

U.S. PATENT DOCUMENTS

| | | | | |
|---|---|---|---|---|
| 7,477,248 | B2 * | 1/2009 | Johnson | 345/214 |
| 2006/0017394 | A1 * | 1/2006 | Tada et al. | 315/169.3 |
| 2009/0135304 | A1 * | 5/2009 | Inoue et al. | 348/712 |
| 2010/0127957 | A1 * | 5/2010 | Meguro et al. | 345/77 |
| 2010/0171770 | A1 * | 7/2010 | Inoue et al. | 345/690 |
| 2010/0328359 | A1 * | 12/2010 | Inoue et al. | 345/690 |
| 2011/0050666 | A1 * | 3/2011 | Inoue et al. | 345/211 |

FOREIGN PATENT DOCUMENTS

JP 2006-038968 2/2006

* cited by examiner

*Primary Examiner* — Lun-Yi Lao
*Assistant Examiner* — Tom Sheng
(74) *Attorney, Agent, or Firm* — SNR Denton US LLP

(57) ABSTRACT

There is provided a display device provided with a display portion, in which pixels having a light-emitting element for self-light-emitting, and a pixel circuit for controlling a current applied to a light-emitting element according to a voltage signal are arranged in a matrix, provided with an average luminance calculation portion calculating an average of luminance of an input video signal, and a light-emitting time setting portion setting a real duty defined every one frame by which light-emitting time for light emitting of the light-emitting element according to a calculated average luminance, wherein the light-emitting time setting portion sets the real duty in such a way that a light-emitting amount defined by a standard duty set beforehand and a maximum luminance among those of a video signal, and a light-emitting amount defined by a real duty to be set and an average luminance become the same as each other.

9 Claims, 5 Drawing Sheets

DISPLAY DEVICE, VIDEO SIGNAL PROCESSING METHOD, AND PROGRAM

CROSS REFERENCES TO RELATED APPLICATIONS

The present invention contains subject matter related to Japanese Patent Application JP 2007-133227 filed in the Japan Patent Office on May 18, 2007, the entire contents of which being incorporated herein by reference.

BACKGROUND OF THE INVENTION

1. Field of the Invention

The present invention relates to a display device, a video signal processing method, and a program.

2. Description of the Related Art

Recently, various kinds of display devices such as an organic electroluminescence display (organic EL display), an organic light emitting diode display (OLED display), a field emission display (FED), a liquid crystal display (LCD), and a plasma display panel (PDP) have been developed as a display device replacing a cathode ray tube (CRT) display.

Among the various above-described display devices, the organic EL display is a display device of a self-light-emitting type, which uses an electroluminescence, and, especially, has been attracting much attention as a next generation display device because the organic EL display is excellent in the motion picture characteristic, the viewing-angle one, and the color reproduction one, for example, in comparison with those of a display device such as an LCD separately requiring a light source. Here, the electroluminescence is a phenomenon in which differential energy is discharged as light when the electronic state of a material (organic EL element) is changed from a ground state to an excited state by an electric field, and the electronic state is returned from an unstable excited state to a steady ground state.

In the above-descried conditions, various kinds of technologies have been developed for the self-light-emitting type display device. A technology for light-emitting time control during one frame period in the self-light-emitting type display device has been described in, for example, Japanese Patent Application Laid-Open No. 2006-38968.

SUMMARY OF THE INVENTION

However, a conventional technology for light-emitting time control during one frame period is only a technology in which the higher average luminance of a video signal causes light-emitting time during one frame period to be shortened. Accordingly, when a video signal with very high luminance is input to a self-light-emitting type display device, a light-emitting amount (signal level I·light-emitting time for a video signal) of a video to be displayed becomes too large, and an over current flows in a light-emitting element.

The present invention has been made, considering the above-described issue, and it is desirable to provide a new and improved display device, a video signal processing method, and a program, according to which light-emitting time during one frame period is controlled based on an input video signal, and an over current may be prevented from flowing in a light-emitting element.

According to an embodiment of the present invention, there is provided a display device provided with a display portion. In the display portion, a pixel, which has a light-emitting element for self-light-emitting according to a current amount and a pixel circuit, which controls a current applied to the light-emitting element according to a voltage signal; a scanning line supplying a selection signal, by which a pixel to be emitted is selected, to the pixel at a predetermined scanning cycle; and a data line supplying the voltage signal, which is corresponding to the input video signal, to the pixel are arranged in a matrix. The display device includes: an average luminance calculation portion calculating an average of luminance of the input video signal during a predetermined period; and a light-emitting time setting portion setting a real duty by which light-emitting time for light emitting of the light-emitting element according to an average luminance calculated in the average luminance calculation portion is defined every one frame, wherein the light-emitting time setting portion sets the real duty in such a way that a light-emitting amount defined by a standard duty set beforehand and a maximum luminance among those of a video signal, and a light-emitting amount defined by a real duty to be set and the average luminance become the same as each other.

The display device can be provided with the average luminance calculation portion and the light-emitting time setting portion. The average luminance calculation portion can calculate an average value of the luminance of a video signal during the predetermined period based on a video signal to be input. The light-emitting time setting portion can set a real duty defining light-emitting time for light emitting of a light-emitting element every one frame according to the average luminance calculated in the average luminance calculation portion. Here, the light-emitting time setting portion can set a real duty in such a way that a light-emitting amount defined by a standard duty set beforehand and a maximum luminance among those of video signals, and a light-emitting amount defined by a real duty to be set and an average luminance become the same as each other. According to the above configuration, a light-emitting time during one frame period can be controlled, and an over current can be prevented from flowing in the light-emitting element.

Moreover, the predetermined period during which the average luminance calculation portion calculates an average of luminance may be one frame.

The light-emitting time for each frame period can be more precisely controlled by the above configuration.

Moreover, the average luminance calculation portion may include: a current ratio adjustment portion in which a correction value for the primary color signal based on a voltage-current characteristic, is multiplied for each of primary color signals included in the video signal; and an average value calculation portion which calculates an average of luminance of a video signal output from the current ratio adjustment portion during a predetermined period.

According to the above configuration, a video and an image, which are faithful to an input video signal, can be displayed.

Further, the light-emitting time setting portion may retain a look up table including correspondences between the luminance of a video signal and the real duty, and the real duty may be uniquely set according to the average luminance calculated in the average luminance calculation portion.

According to the above configuration, the light-emitting amount for each frame can be defined.

Further, the upper limit value of the real duty may be defined beforehand in the look up table retained in the light-emitting time setting portion, and a real duty equal to, or smaller than the upper limit value of the real duty defined beforehand may be set in the light-emitting time setting portion.

According to the above configuration, a constant balance can be taken in an relation between "luminance" and "motion blurring" involved in setting the real duty.

There may be further provided a linear conversion portion in which gamma correction of the input video signal is performed for correction to a linear video signal, and a video signal input to the average luminance calculation portion is a video signal output from the linear conversion portion.

In the above configuration, light-emitting time for one frame period can be controlled, and an over current can be prevented from flowing in a light-emitting element.

There may be further provided a gamma conversion portion in which there is performed gamma correction of the video signal according to the gamma characteristic of the display portion.

According to the above configuration, a video and an image, which are faithful to an input video signal, can be displayed by the above configuration.

According to an embodiment of the present invention described above, there is provided a video signal processing method in a display device provided with a display portion. In the display portion, a pixel, which has a light-emitting element for self-light-emitting according to a current amount, and a pixel circuit, which controls a current applied to the light-emitting element according to a voltage signal; a scanning line supplying a selection signal, by which a pixel to be emitted is selected, to the pixel at a predetermined scanning cycle; and a data line supplying the voltage signal, which is corresponding to the input video signal, to the pixel are arranged in a matrix. The video signal processing method includes: a step at which the average of luminance of the input video signal during a predetermined period is calculated; and a step at which there is set a real duty defining light-emitting time for light emitting of the light-emitting element every one frame according to the average luminance calculated at the step of calculating the average of the luminance, wherein the real duty is set at the step of setting the real duty in such a way that a light-emitting amount defined by a standard duty set beforehand and a maximum luminance among those of a video signal, and a light-emitting amount defined by a real duty to be set and the average luminance become the same as each other.

By using the above method, light-emitting time for one frame period can be controlled, and an over current can be prevented from flowing in a light-emitting element.

According to the embodiments of the present invention described above, there is provided a program involved in a display device provided with a display portion. In the display portion, a pixel, which has a light-emitting element for self-light-emitting according to a current amount, and a pixel circuit, which controls a current applied to the light-emitting element according to a voltage signal; a scanning line supplying a selection signal, by which a pixel to be emitted is selected, to the pixel at a predetermined scanning cycle; and a data line supplying the voltage signal, which is corresponding to the input video signal, to the pixel are arranged in a matrix. According to the program, a computer functions as a unit for calculating the average of luminance of the input video signal during a predetermined period, and as a unit for setting a real duty defining light-emitting time for light emitting of the light-emitting element every one frame according to the average luminance calculated at the step of calculating the average of the luminance.

According to the above program, light-emitting time for one frame period can be controlled, and an over current can be prevented from flowing in a light-emitting element.

According to the embodiments of the present invention described above, light-emitting time for one frame period can be controlled, and an over current can be prevented from flowing in a light-emitting element.

DETAILED DESCRIPTION OF THE PREFERRED EMBODIMENTS

Figure 1:
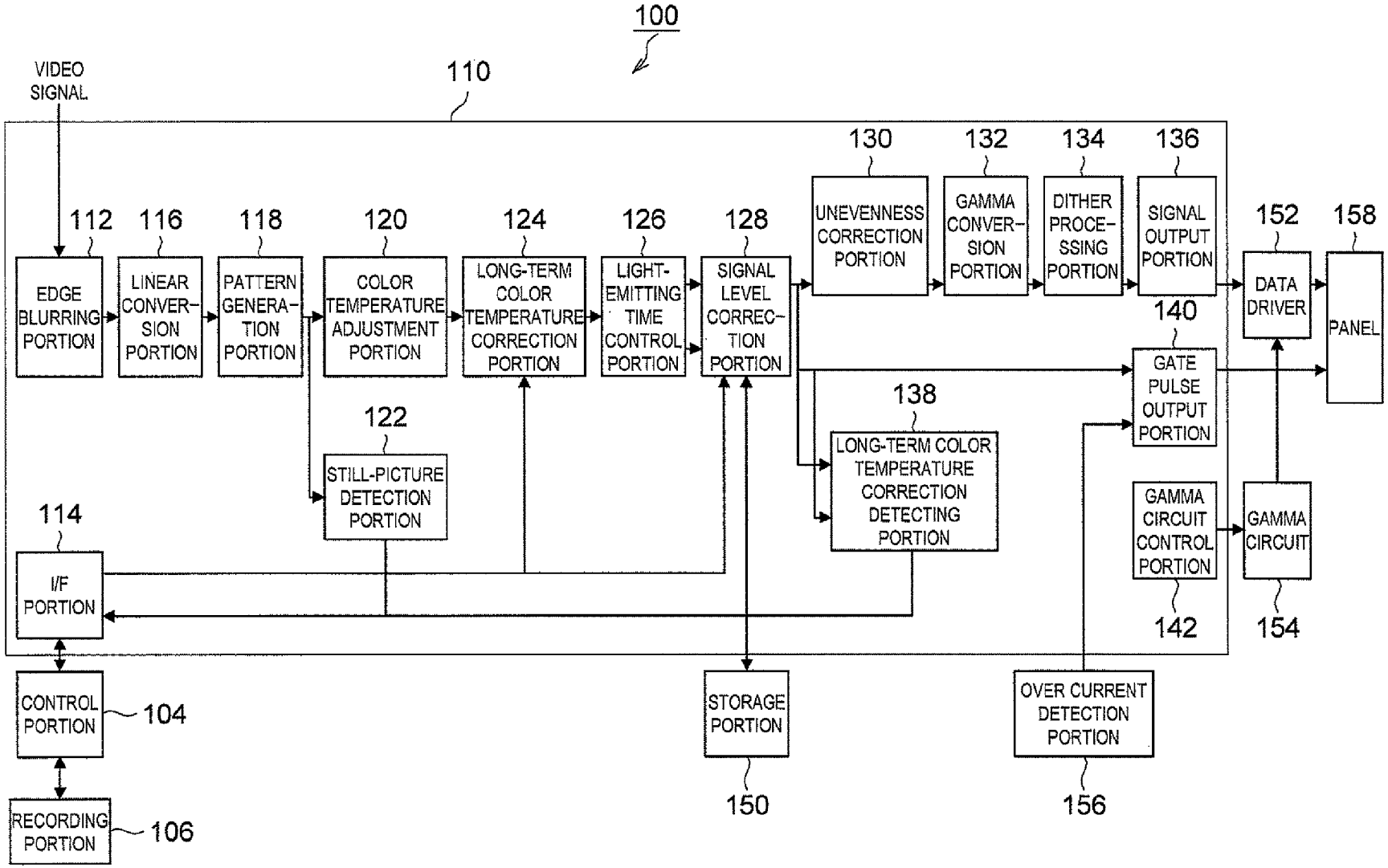
FIG. 1 is an explanatory view showing one example for a configuration of a display device according to an embodiment of the present invention.

Hereafter, preferred embodiments of the present invention will be described in detail with reference to the appended drawings. Note that in this specification and the appended drawings, structural elements that have substantially the same functions and structures are denoted with the same reference numerals and a repeated explanation of these structural elements is omitted.

(Display Device According to an Embodiment of the Present Invention)

First, one example for a configuration of display device according to an embodiment of the present invention will be explained. FIG. 1 is an explanatory view showing one example for a configuration of a display device 100 according to the embodiment of the present invention. Hereafter, an organic EL display of a self-light-emitting type display device will be explained as a display device according to the embodiment of the present invention. Hereafter, explanation will be made, assuming that a video signal input to the display device 100 is, for example, a digital signal used for digital broadcasting and the like. However, the video signal is not limited to the above-described one, and can be assumed to be, for example, an analog signal used for analog broadcasting and the like.

Referring to FIG. 1, the display device 100 can be provided with: a control portion 104; a recording portion 106; a video signal processing portion 110; a storage portion 150; a data driver 152; a gamma circuit 154; an over current detection portion 156; and a panel 158.

The control portion 104 includes, for example, a micro processing unit (MPU), and the like, and can control the whole display device 100. As a control by the control portion 104, for example, signal processing of a signal transmitted from the video signal processing portion 110 is performed, and the processed result is delivered to the video signal processing portion 110. Here, the signal processing in the control portion 104 includes, for example, calculation of a gain used for adjustment of the luminance of an image displayed on the panel 158. However, the above-described processing is not limited to the calculation.

The recording portion 106 is one storage unit provided in the display device 100, and can retain information for controlling the video signal processing portion 110 in the control portion 104. The information retained in the recording portion 106 includes, for example, a table in which a parameter is set beforehand. The control portion 104 uses the above parameter for signal processing of a signal transmitted from the video signal processing portion 110. Moreover, the recording portion 106 includes: a magnetic recording medium such as a hard disk; and a nonvolatile memory such as an electronically erasable and programmable read only memory (EEPROM); a flash memory; a magnetoresistive random access memory (MRAM); a ferroelectric random access memory (FeRAM); and a phase change random access memory (PRAM). However, the recording portion 106 is not limited to the above-described ones.

The video signal processing portion 110 can perform signal processing of an input video signal. Hereafter, one example of a configuration of the video signal processing portion 110 will be shown.

[One Example of Configuration of Video Signal Processing Portion 110]

The video signal processing portion 110 can be provided with: an edge blurring portion 112; an I/F portion 114; a linear conversion portion 116; a pattern generation portion 118; a color temperature adjustment portion 120; a still-picture detection portion 122; a long-term color temperature correction portion 124; a light-emitting-time control portion 126; a signal level correction portion 128; an unevenness correction portion 130; a gamma conversion portion 132; a dither processing portion 134; a signal output portion 136; a long-term color temperature correction detection portion 138; a gate pulse output portion 140; and a gamma circuit control portion 142.

The edge blurring portion 112 performs signal processing for edge blurring of an input video signal. Concretely, the edge blurring portion 112 controls burning phenomenon of an image on the panel 158 (will be described later) by a configuration in which an edge is blurred, for example, by intentionally shifting an image represented by a video signal. Here, the burning phenomenon of an image is a deterioration phenomenon of a luminescence characteristic. The deterioration phenomenon is generated when the luminescence frequency of a specific pixel included on the panel 158 is higher than those of other pixels. A pixel deteriorated by the burning phenomenon of an image has a reduced luminance in comparison with those of other not-deteriorated pixels. Thereby, there is caused larger difference between the luminance of a deteriorated pixel and that of a not-deteriorated portion around the related pixel. Based on the above luminance difference, it looks from a user of the display device 100 watching, for example, a video, or an image displayed on the display device 100 as if characters are seemed to have been burnt onto the screen.

The I/F portion 114 is an interface to transmit and receive a signal to and from a component, for example, the control portion 104 and the like outside the video signal processing portion 110.

The linear conversion portion 116 corrects the input video signal to a linear video signal by gamma correction. When the gamma value of an input video signal is, for example, "2.2", the linear conversion portion 116 corrects the video signal in such a way that the gamma value becomes "1.0".

The pattern generation portion 118 generates a test pattern which is used for signal processing in the display device 100. A test pattern used in signal processing in the display device 100 includes, for example, a test pattern used for display inspection of the panel 158. However, the pattern is not limited to the above-described pattern.

The color temperature adjustment portion 120 adjusts a color displayed on the panel 158 in the display device 100 by adjusting the color temperature of an image represented by a video signal. Here, the display device 100 can be provided with a color temperature adjustment unit (not shown) by which a user using the display device 100 can adjust a color temperature. The display device 100 can adjust a color temperature of an image displayed on a screen by providing a color temperature adjustment unit (not shown). Here, the color temperature adjustment unit (not shown), which can be provided in the display device 100, includes, for example, a button, a direction key, a rotation type selector such as a jog dial, or, a combination of the above-described components, but is not limited to the above-described ones.

The still-picture detection portion 122 can judge that a video signal represents a still image, when a predetermined time difference is not detected at detection of a time series difference of an input video signal. The detection result of the still-picture detection portion 122 can be used for, for example, prevention of burning phenomenon of the panel 158, and for deterioration control of a light-emitting element.

The long-term color temperature correction portion 124 corrects deteriorations of sub pixels with age, wherein the sub pixels form each pixel included on the panel 158, and include a red one (hereafter, called "R"), a green one (hereafter, called "G") one, and a blue one (hereafter, called "B") one. Here, the LT characteristics (luminance-time characteristics) for light-emitting elements (organic EL elements) of each color forming a sub pixel of a pixel are different from each other. Accordingly, when an image represented by a video signal is displayed on the panel 158, the balance of colors is lost along with time-base deterioration of a light-emitting element. Accordingly, the long-term color temperature correction portion 124 compensates time-base deterioration of light-emitting elements (organic EL elements) forming a sub pixel.

The light-emitting-time control portion 126 controls the light-emitting time of each pixel included on the panel 158 every one frame period. More concretely, the light-emitting-time control portion 126 can control a ratio of light-emitting time of a light-emitting element during one frame period (that is, a ratio between light emitting time and picture erasing time during one frame period, and, hereafter, called "duty"). The display device 100 can display an image represented by a video signal for desired period of time by selectively applying a current to a pixel included on the panel 158.

Moreover, the light-emitting-time control portion 126 can control light-emitting time (duty) in such a way that an over current is prevented from flowing in each of pixels (strictly speaking, light-emitting elements included in each pixel) included on the panel 158. Here, an over current prevented by the light-emitting-time control portion 126 mainly means that a current with a current amount larger than a permissible amount for a pixel included on the panel 158 flows in a pixel (overload). A detailed configuration of the light-emitting-time control portion 126 according to an embodiment of the present invention, and control of light-emitting time in the display device 100 according to an embodiment of the present invention will be described later.

The signal level correction portion 128 judges a risk factor for generation of the burning phenomenon of an image in order to prevent generation of the burning phenomenon of an image. Then, the signal level correction portion 128 adjusts the luminance of a video displayed on the panel 158 by correcting the signal level of the video signal in order to prevent the burning phenomenon of an image, for example, when the risk factor reaches a value equal to or, larger than a predetermined value.

The long-term color temperature correction detection portion 138 detects information used for compensation of the time-base deterioration of a light-emitting element in the long-term color temperature correction portion 124. The information detected in the long-term color temperature correction detection portion 138 can be sent to, for example, the control portion 104 through the I/F portion 114, and can be recorded in the recording portion 106 through the control portion 104.

The unevenness correction portion 130 corrects an unevenness such as lateral stripes, longitudinal stripes, and irregularities over the whole screen, wherein the unevenness is possibly generated when an image or a video represented by a video signal is displayed on the panel 158. The unevenness correction portion 130 can correct the unevenness, based on, for example, the level and the coordinate position of an input video signal.

The gamma conversion portion 132 performs gamma correction of a video signal (more strictly speaking, a video signal output from the unevenness correction portion 130) which has undergone gamma correction in the linear conversion portion 116 in order to obtain a linear video signal, and corrects the video signal in such a way that the video signal has a predetermined gamma value. Here, the predetermined gamma value has a value by which the VI characteristic (voltage-current characteristic, strictly, the VI characteristic of a transistor included in a pixel circuit) of a pixel circuit (will be described later) provided on the panel 158 of the display device 100 can be cancelled. A relation between a light quantity of an object, which is represented by a video signal and the amount of a current applied to a light-emitting element can be linearly treated by a configuration in which the gamma conversion portion 132 performs gamma correction in such a way that a video signal has the predetermined gamma value.

The dither processing portion 134 performs dithering processing of a video signal which has undergone gamma correction in the gamma conversion portion 132. Here, the dithering means that colors which can be displayed are combined for expressing neutral colors in an environment in which the usable number of colors is small. Based on the dithering processing in the dither processing portion 134, colors which can hardly be originally displayed on the panel 158 can be virtually produced for display.

The signal output portion 136 outputs a video signal, which has undergone the dithering processing in the dither processing portion 134, to the outside of the video signal processing portion 110. Here, the video signal output from the signal output portion 136 can be treated, for example, as an independent signal to each of R, G, and B colors.

The gate pulse output portion 140 outputs a selection signal by which light emitting, and light-emitting time of each pixel included in the panel 158 are controlled. Here, the selection signal is based on the duty output from the light-emitting-time control portion 126. There can be provided a configuration, for example, in which, when the selection signal is at a high level, a light-emitting element included in a pixel emits light, and, when the selection signal is at a low level, a light-emitting element included in a pixel does not emit light.

The gamma circuit control portion 142 outputs a predetermined set value to the gamma circuit 154 (will be described later). Here, a predetermined set value output to the gamma circuit 154 by the gamma circuit control portion 142 possibly includes, for example, a standard voltage given as a ladder resistance of a digital-to-analog converter included in the data driver 152 (will be described later).

By the above-described configuration, the video signal processing portion 110 can perform various kinds of signal processing for input video signals.

The storage portion 150 is another storage unit included in the display device 100. Information retained in the storage portion 150 includes, for example, information having correspondence between information on a pixel, or a group of pixels emitting light with a luminance exceeding a predetermined luminance, and information on the exceeding amount, wherein the information having the correspondence is required when a luminance is corrected in the signal level correction portion 128. Moreover, the storage portion 150 may include, for example, a volatile memory such as a synchronous dynamic random access memory (SDRAM), and a static random access memory (SRAM). However, the storage portion 150 is not limited to the above-described ones, and may include a magnetic recording medium such as a hard disk, or a nonvolatile memory such as a flash memory.

The over current detection portion 156 detects an over current, and notifies generation of the over current to the gate pulse output portion 140, for example, when the over current is generated by a wiring short on a base (not shown) provided with components in the display device 100. Then, the over current can be prevented from being applied to the panel 158 by a configuration in which the gate pulse output portion 140 receiving the notification on generation of the over current from the over current detection portion 156 does not apply the selection signal, for example, to each pixel included on the panel 158.

The data driver 152 outputs a voltage signal to the panel 158, after a video signal output from the signal output portion 136 is converted into a voltage signal to be applied to each pixel on the panel 158. Here, the data driver 152 can be provided with a digital-to-analog converter by which a video signal as a digital signal is converted into a voltage signal as an analog signal.

The gamma circuit 154 outputs a standard voltage which is given to the ladder resistance of the digital-to-analog converter included in the data driver 152. The standard voltage which the gamma circuit 154 outputs to the data driver 152 can be controlled by the gamma circuit control portion 142.

The panel 158 is a display portion provided in the display device 100. The panel 158 is provided with a plurality of pixels which are arranged in a matrix (in a row and column state). Moreover, the panel 158 is provided with a data line to which a voltage signal corresponding to a video signal in correspondence with each pixel is applied, and a scanning line to which a selection signal is applied. The panel 158 displaying a video, for example, with a standard definition (SD) resolution has at least pixels with a number of 640 ×480=307200 (data lines ×scanning lines). When the related pixel includes sub pixels of R, G, and B for color display, the number of the sub pixels is 640 ×480 ×3=921600 (number of data lines ×number of scanning lines ×number of pixels). Similarly, the panel 158 displaying a video with a high definition (HD) resolution has pixels with a number of 1920 ×1080, and, for color display, includes sub pixels with a number of 1920 ×1080 ×3.

Application Example of Sub Pixel (Light-Emitting Element): Organic EL Element]

When a light-emitting element forming a sub pixel in each pixel is an organic EL element, the IL characteristic (current-luminescence amount characteristic) becomes linear. As described above, the display device 100 can have a configuration in which, by gamma correction in the gamma conversion portion 132, there can be obtained a linear relation between light quantity of an object, which is represented by a video signal, and an amount of currents applied to a light-emitting element. Accordingly, a video and an image, which are faithful to a video signal, can be displayed because the display device 100 can have a linear relation between light quantity of an object which is represented by a video signal, and a light-emitting amount.

Moreover, the panel 158 is provided with a pixel circuit (not shown) by which an amount of currents to be applied is controlled for each pixel. The pixel circuit includes for example, a switch element and a drive element for controlling a current amount according to a scanning signal and a voltage signal to be applied, and a capacitor for holding a voltage signal. The switch element and the drive element include, for example, a thin film transistor. Here, each of transistors provided in the pixel circuits individually has a different VI characteristic from each other. Accordingly, the VI characteristic as the whole panel 158 is different from that of a panel provided in other display devices having the same configuration as that of the display device 100. Accordingly, in the display device 100, a relation between the light quantity of the object represented by the video signal and the amount of a current applied to a light-emitting element is assumed to be linear by gamma correction which is corresponding to the panel 158, and is performed in the gamma conversion portion 132, and by which the VI characteristic of the panel 158 is cancelled by the gamma correction.

The display device 100 according to an embodiment of the present invention can display a video and an image, which are corresponding to the input video signal, by adopting the configuration shown in FIG. 1. Here, FIG. 1 has shown a video signal processing portion 110 in which the pattern generation portion 118 is provided at the post stage of the linear conversion portion 116. However, the configuration of the linear conversion portion 116 is not limited to the above-described one, and the video signal processing portion can have a configuration in which the pattern generation portion 118 is provided at the prestage of the linear conversion portion 116.

(Outline of Transition of Signal Characteristic in Display Device 100)

Then, the outline of the transition of the signal characteristic in the display device 100 according to the above-described embodiment of the present invention will be explained. FIG. 2 is an explanatory view showing the outline of the transition of the signal characteristic in the display device 100 according to an embodiment of the present invention.

Figure 2A:
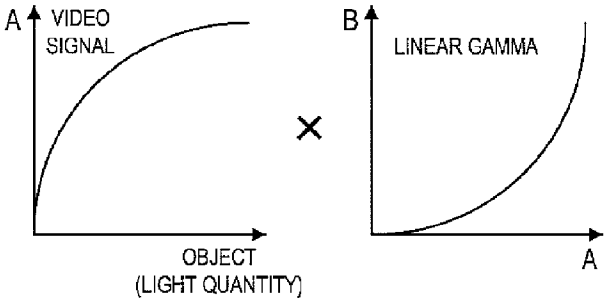
FIG. 2 is an explanatory view showing an outline of the transition of a signal characteristics in the display device according to an embodiment of the present invention.

Here, time-base processing in the display device 100 is shown in graphs shown in FIG. 2A through FIG. 2F. Left drawings in the FIG. 2B through FIG. 2E show the signal characteristics as processing results at the prestage as expressed, for example, "a signal characteristic as a processing result in FIG. 2A is corresponding to the left drawing of FIG. 2B". The right drawings in FIG. 2A through FIG. 2E represent signal characteristics used as a coefficient in processing.

[Transition of First Signal Characteristic: Transition by Processing in Linear Conversion Portion 116]

As shown in the left drawing in FIG. 2A, for example, a video signal (video signal input to the video signal processing portion 110) transmitted from a broadcasting station and the like has a predetermined gamma value (for example, "2.2"). In the linear conversion portion 116 in the video signal processing portion 110, a video signal is corrected into a video signal with a linear relation between a light quantity of an object represented by the video signal and the output B by performing multiplication between a gamma curve (right drawing in FIG. 2A) and a gamma curve (left drawing in FIG. 2A) in such a way that the gamma value of a video signal input to the video signal processing portion 110 is cancelled, wherein the gamma curve (linear gamma; right drawing in FIG. 2A) is reverse to the gamma curve (left drawing in FIG. 2A) represented by a video signal input to the video signal processing portion 110.

[Transition of Second Signal Characteristic: Transition by Processing in Gamma Conversion Portion 132]

In the gamma conversion portion 132 in the video signal processing portion 110, multiplication between a gamma curve unique to the panel 158 and a gamma curve (panel gamma; right drawing in FIG. 2B) reverse to the gamma curve unique to the panel 158 is performed beforehand in order to cancel the VI characteristic (right drawing in FIG. 2D) of a transistor provided on the panel 158.

[Transition of Third Signal Characteristic: Transition by Digital-to-Analog Conversion in Data Driver 152]

Figure 2B:
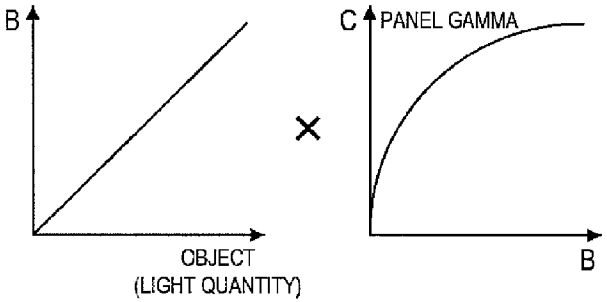
Figure 2C:
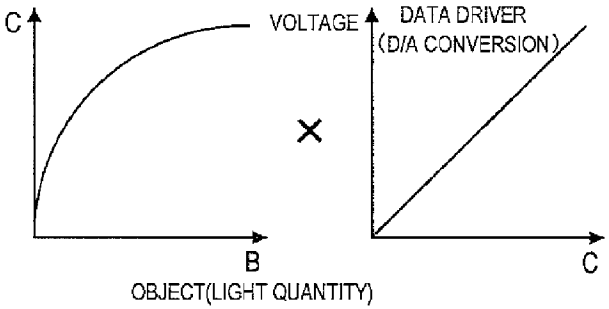

FIG. 2C shows a case in which digital-to-analog conversion of a video signal is performed in the data driver 152. As shown in FIG. 2C, a relation between a light quantity of an object represented by a video signal in the video signal and a voltage signal obtained by digital-to-analog conversion of a video signal is expressed in the left drawing in FIG. 2D by digital-to-analog conversion of the video signal in the data driver 152.

[Transition of Forth Signal Characteristic: Transition of Pixel Circuit on Panel 158]

Figure 2D:
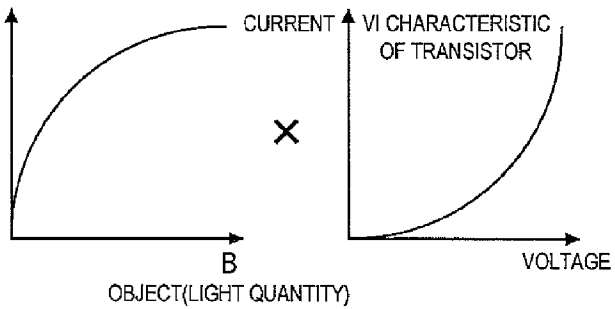

FIG. 2D shows a case in which a voltage signal is applied to a pixel circuit provided on the panel 158 by the data driver 152. As shown in FIG. 2B, in the gamma conversion portion 132 of the video signal processing portion 110, multiplication of a panel gamma corresponding to the VI characteristic of a transistor provided on the panel 158 is performed beforehand. Accordingly, when a voltage signal is applied to a pixel circuit provided on the panel 158, a relation between a light quantity of an object represented by a video signal in the video signal and a current applied to a pixel circuit becomes linear as shown in the left drawing in FIG. 2E.

[Transition of Fifth Signal Characteristic: Transition of Light-Emitting Element (Organic EL Element) on Panel 158]

Figure 2E:
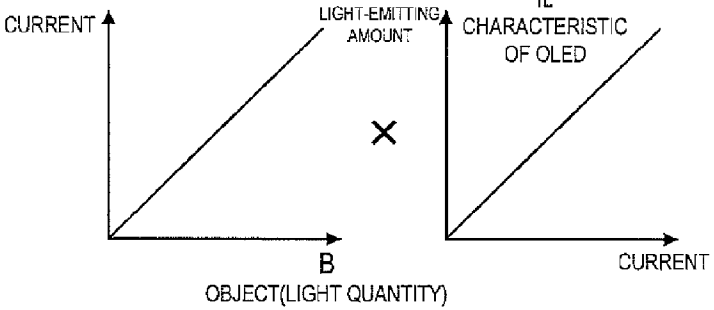
Figure 2F:
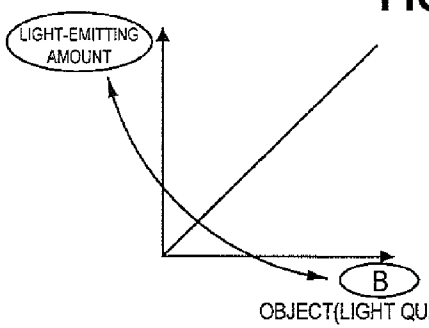

As shown in the right drawing FIG. 2E, the IL characteristic of an organic EL element (OLED) becomes linear. Accordingly, in a light-emitting element on the panel 158, a relation between a light quantity of an object represented by a video signal in the video signal and a light-emitting amount based on light emitting from a light-emitting element also becomes linear (FIG. 2F) by multiplication between characteristics of components with a linear signal characteristic as shown in FIG. 2E.

As shown in FIG. 2, a linear relation between the light quantity of an object represented by an input video signal and a light emitting amount by light emitting from a light-emitting element can be obtained according to the display device 100. Accordingly, the display device 100 can display a video and an image, which are faithful to a video signal.

(Control of Light-Emitting Time for One Frame Period)

Then, control of light-emitting time during one frame period will be explained based on an embodiment according to the present invention. The control of light-emitting time during one frame period in the embodiment of the present invention can be performed in the light-emitting-time control portion 126 of the video signal processing portion 110.

Figure 3:
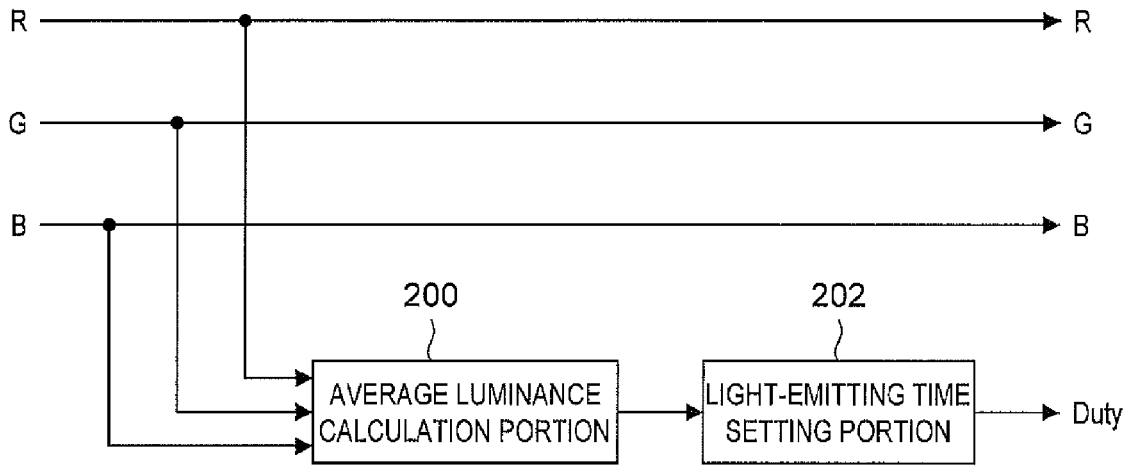
FIG. 3 is a block diagram showing one example of a light-emitting time control portion according to an embodiment of the present invention.

FIG. 3 is a block diagram showing one example of the light-emitting-time control portion 126 according to an embodiment of the present invention. Hereafter, explanation will be made, assuming that a video signal input to the light-emitting-time control portion 126 is an independent signal to each of R, G, and B colors, which are corresponding to an image every one frame period.

Referring to FIG. 3, the light-emitting-time control portion 126 is provided with an average luminance calculation portion 200 and a light-emitting time setting portion 202.

The average luminance calculation portion 200 calculates an average value of luminance during a predetermined period based on input video signals of R, G, and B. Here, the predetermined period includes, for example, one frame period. However, the period is not limited to the above-described one, and may be, for example, two frame periods.

Moreover, the average luminance calculation portion 200 can calculate, for example, the average value of luminance every predetermined period (that is, calculates an average value of luminance in a constant cycle). However, the calculation is not limited to every predetermined period, and the predetermined period may be a variable period.

Hereafter, explanation will be made, assuming that the predetermined period is one frame period, and the average luminance calculation portion 200 calculate the average value of luminance every one frame period.

[Configuration of Average Luminance Calculation Portion 200]

Figure 4:
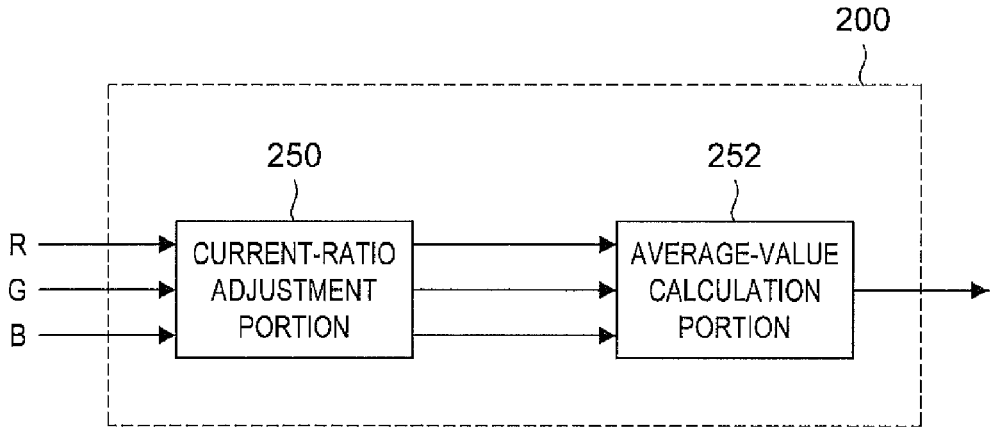
FIG. 4 is a block diagram showing an average luminance calculation portion according to an embodiment of the present invention.

FIG. 4 is a block diagram showing the average luminance calculation portion 200 according to an embodiment of the present invention. Referring to FIG. 4, the average luminance calculation portion 200 is provided with a current ratio adjustment portion 250 and an average value calculation portion 252.

The current ratio adjustment portion 250 adjusts a current ratio of input video signals of R, G, and B by multiplication between each of input video signals of R, G, and B and a predetermined correction coefficient for each color. Here, the predetermined correction coefficients have different values for each color, and the values are corresponding to each of VI ratios (voltage-current ratios) of a light-emitting element of R, a light-emitting element of G, and a light-emitting element of B, which form a pixel included on the panel 158.

Figure 5:
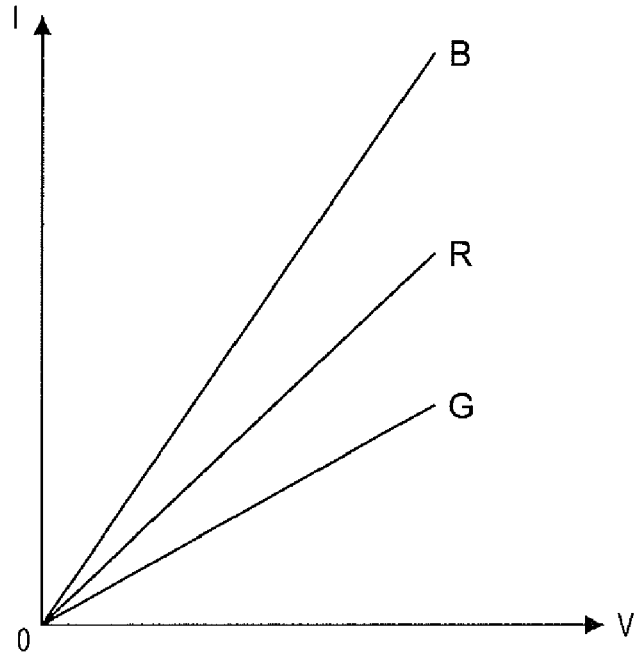
FIG. 5 is an explanatory view showing one example of VI ratios of light-emitting elements of each color forming a pixel according to an embodiment of the present invention.

FIG. 5 is an explanatory view showing one example of VI ratios of light-emitting elements of each of colors forming a pixel according to an embodiment of the present invention. As shown in FIG. 5, the VI ratios of the light-emitting elements of each of colors forming a pixel are different from each other as described in the following, "the ratio of a light-emitting element of B>· ratio of a light-emitting element of R>·ratio of a light-emitting element B". Here, the display device 100 can perform processing in a linear region by a configuration in which the gamma value unique to the panel 158 is cancelled by multiplication between a gamma curve unique to the panel 158 and a gamma curve reverse to the gamma curve unique to the panel 158 in the gamma conversion portion 132 as shown in FIG. 2. Accordingly, the VI ratios for each of light-emitting elements of R, G, and B can be obtained beforehand for example, by fixing a duty to a predetermined value (for example, "0.25") and by leading a VI relation, as shown in FIG. 5, beforehand.

Here, there is acceptably provided a configuration in which the current ratio adjustment portion 250 is provided with a storage unit, and the predetermined correction coefficients used in the current ratio adjustment portion 250 are retained in the storage unit. Here, the storage unit included in the current ratio adjustment portion 250 includes a nonvolatile memory such as an EEPROM and a flash memory. However, the present invention is not limited to the above-described ones. Moreover, the predetermined correction coefficients used in the current ratio adjustment portion 250 are retained in the storage unit provided in the display device 100, and can be read by the current ratio adjustment portion 250 appropriately, wherein the storage unit includes the recording portion 106, the storage portion 150, and the like.

The average value calculation portion 252 calculates an average luminance (APL; average picture level) during one frame period using video signals of R, G, and B after adjustment by the current ratio adjustment portion 250. Here, a method for calculating an average luminance during one frame period includes, for example, a method using an arithmetic average, wherein the calculation is performed by the average value calculation portion 252. However, the method is not limited to the above-described one. For example, a geometric average, or a weighted average can be used for the calculation.

The average luminance calculation portion 200 outputs an average luminance by calculating the average luminance during one frame period as described above.

Referring to FIG. 3 again, the light-emitting time setting portion 202 sets a real duty according to the average luminance during one frame period, wherein the average luminance is calculated in the average luminance calculation portion 200. Here, the real duty refers to a ratio (that is, the above-described "duty") between light emitting time and picture erasing time during one frame period, wherein the ratio defines light-emitting time for light emitting of a pixel (light-emitting element) every one frame period.

Moreover, the real duty can be set in the light-emitting time setting portion 202, using, for example, a look up table including a correspondence between an average luminance during one frame period and a real duty.

[Derivation Method of Value Retained in a Look Up Table According to an Embodiment of the Present Invention]

Figure 6:
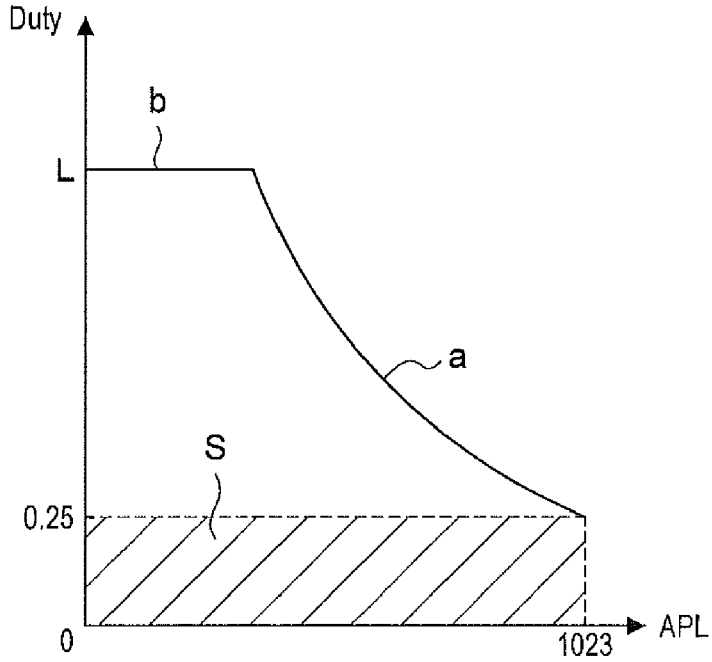
FIG. 6 is an explanatory view explaining a derivation method of a value retained in a look up table according to an embodiment of the present invention.

Then, a method for deriving a value retained in the look up table according to an embodiment of the present invention will be explained. FIG. 6 is an explanatory view explaining a method for deriving a value retained in the look up table according to an embodiment of the present invention, and shows a relation between an average luminance (APL) during one frame period and a real duty. Here, FIG. 6 has shown an example in which the average luminance during one frame period is expressed by digital data of ten bits, but it is obvious that the average luminance during one frame period according to an embodiment of the present invention is not limited to digital data of ten bits.

The look up table according to an embodiment of the present invention is derived based on a light-emitting amount for a case in which the luminance is the maximum (at this time, an image of "white" is displayed on the panel 158) in the standard duty. More concretely speaking, a real duty is retained in the look up table according to an embodiment of the present invention in such a way that a largest light-emitting amount in the standard duty, and a light-emitting amount defined by a real duty and an average luminance during one frame period are the same as each other, wherein the average luminance is calculated in the average luminance calculation portion 200. Here, the standard duty is a duty which is determined beforehand, and defines a light-emitting amount to derive a real duty.

A light-emitting amount during one frame period can be expressed by the following Formula 1. Here, Lum expresses a light-emitting amount, Sig denotes a signal level, and Duty represents light-emitting time. Accordingly, a standard duty is determined beforehand, and a signal level is set at a maximum luminance to uniquely derive a light-emitting amount by which the real duty is derived.

$$Lum=(Sig)\times(\text{Duty}) \quad \text{(FORMULA 1)}$$

As described above, in the embodiment of the present invention, the maximum luminance is set as a signal level deriving a light-emitting amount to derive a real duty. That is, a light-emitting amount derived from the Formula 1 becomes the largest light-emitting one in the standard duty. Therefore, according to a configuration in which the look up table according to the embodiment of the present invention retains a real duty in such a way that the largest light-emitting amount in the standard duty, and the light-emitting amount defined by the real duty and the average luminance during one frame period are the same as each other, a light-emitting amount during one frame period does not become a light-emitting amount larger than the largest light-emitting amount in the standard duty, wherein the average luminance is calculated by the average luminance calculation portion 200.

Accordingly, the light-emitting time setting portion 202 sets a real duty using the look up table according to the embodiment of the present invention, and the display device 100 can prevent an over current from flowing in each pixel (strictly speaking, light-emitting elements in each pixel) included the panel 158.

Moreover, for example, when the average luminance calculation portion 200 calculates an average value of luminance every one frame period, the light-emitting time setting portion 202 can control the light-emitting time during the subsequent frame period (for example, the next frame period) in more detail.

Hereafter, one example of the look up table according to an embodiment of the present invention will be explained referring to FIG. 6.

[One Example of Look Up Table According to an Embodiment of the Present Invention]

An average luminance during one frame period and a real duty are retained in correspondence with each other in the look up table according to the embodiment of the present invention, for example, in such a way that a point defined by the luminance and the duty is on a curve a, or a straight line b shown in FIG. 6.

An area S shown in FIG. 6 represents a light-emitting amount when the luminance is the maximum, assuming that the standard duty is determined as "0.25 (25%)". Obviously, the standard duty according to an embodiment of the present invention is not limited to "0.25 (25%)". The standard duty can be set to, for example, the characteristic (for example, the characteristic of the light-emitting element, and the like) of the panel 158 provided in the display device 100.

The curve a shown in FIG. 6 is a curve on which, a point passes, when the real duty is larger than 25%, in such a way that the product of an average luminance (APL) during one frame period and a real duty (duty) is equal to the area S.

The straight line b shown in FIG. 6 is a straight line which defines the upper bound L of a real duty to the curve a. As shown in FIG. 6, an upper bound of the real duty can be provided in the look up table according to the embodiment of the present invention. The upper bound is provided in the real duty in the embodiment of the present invention in order to solve an issue caused by, for example, a trade-off relation between a "luminance" related to the duty and "motion blurring" when a motion image is displayed. Here, there will be explained in the following the issue caused by the trade-off relation between a "luminance" related to the duty and "motion blurring".

<Case of Large Duty>·

Luminance: Becomes higher

Motion Blurring: Becomes larger

<Case of Small Duty>·

Luminance: Becomes lower

Motion blurring: Becomes smaller

Accordingly, in the look up table according to the embodiment of the present invention, an issue caused by a trade-off relation between the luminance and the motion blurring is solved based on constant balance between the "luminance" and the "motion blurring" by setting the upper limit value at an upper bound L. Here, the upper bound L of the real duty can be set to, for example, the characteristic (for example, the characteristic of the light-emitting element, and the like) of the panel 158 provided in the display device 100.

The light-emitting time setting portion 202 can set a real duty according to an average luminance during one frame period by using a look up table in which an average luminance during one frame period and a real duty are retained in correspondence with each other, for example, in such a way that a point defined by the luminance and the duty is on a curve a, or a straight line b shown in FIG. 6, wherein the average luminance is calculated in the average luminance calculation portion 200.

Moreover, the light-emitting time setting portion 202 is provided with a duty retaining unit retaining a set real duty, and the set real duty can be also updated appropriately for retaining every time the average luminance calculation portion 200 calculates an average luminance. As the light-emitting time setting portion 202 is provided with the retaining unit, duties corresponding to each frame period can be output by outputting a real duty retained in the duty retaining unit during each frame period even when the average luminance calculation portion 200 calculates an average luminance during a period longer than one frame period. Here, the duty retaining unit included in the light-emitting time setting portion 202 includes, for example, a volatile memory such as an SRAM, but the unit is not limited to the above-described ones. Moreover, in the above-described case, the light-emitting time setting portion 202 can output a real duty in synchronization with each frame period, for example, according to a signal from a timing generator (not shown) provided in the display device 100.

As described above, the display device 100 according to the embodiment of the present invention calculates an average luminance from a video signals of R, G, and B, which are input during one frame period (predetermined period), and a real duty corresponding to the calculated average luminance is set. A real duty related to the embodiment of the present invention is set a value in such a way that the largest light-emitting amount in the standard duty, and the light-emitting amount defined by the real duty and the average luminance during one frame period (predetermined period) are the same as each other. As a light-emitting amount during one frame period does not become a light-emitting amount larger than the largest light-emitting amount in the standard duty in the display device 100, the display device 100 can prevent an over current from flowing in each pixel included on the panel 158 (strictly speaking, on the light-emitting elements included in each pixel).

Moreover, the display device 100 can solve an issue caused by a trade-off relation between the luminance and the motion blurring based on a constant balance in a relation between "luminance" and "motion blurring" by setting an upper limit value in the real duty according to the embodiment of the present invention.

Furthermore, a linear relation between the light quantity of an object represented by an input video signal and the light-emitting amount obtained by light-emitting of a light-emitting element can be obtained in the display device 100. Accordingly, the display device 100 can display a video and an image, which are faithful to an input video signal.

The display device 100 has been explained as an example in the above embodiment of the present invention. However, embodiments of the present invention are not limited to the above forms. The present invention can be applied to, for example, a self-light-emitting type television set by which television broadcasting is received and a video is displayed, and a computer such as a personal computer (PC) which has a display unit in the outside or the inside of the PC.

(Program According to Embodiment of the Present Invention)

According to a program through which the display device 100 according to the embodiment of the present invention functions as a computer, light-emitting time during one frame period can be controlled, and an over current can be prevented from flowing in a light-emitting element.

(Video Signal Processing Method According to Embodiment of the Present Invention)

Figure 7:
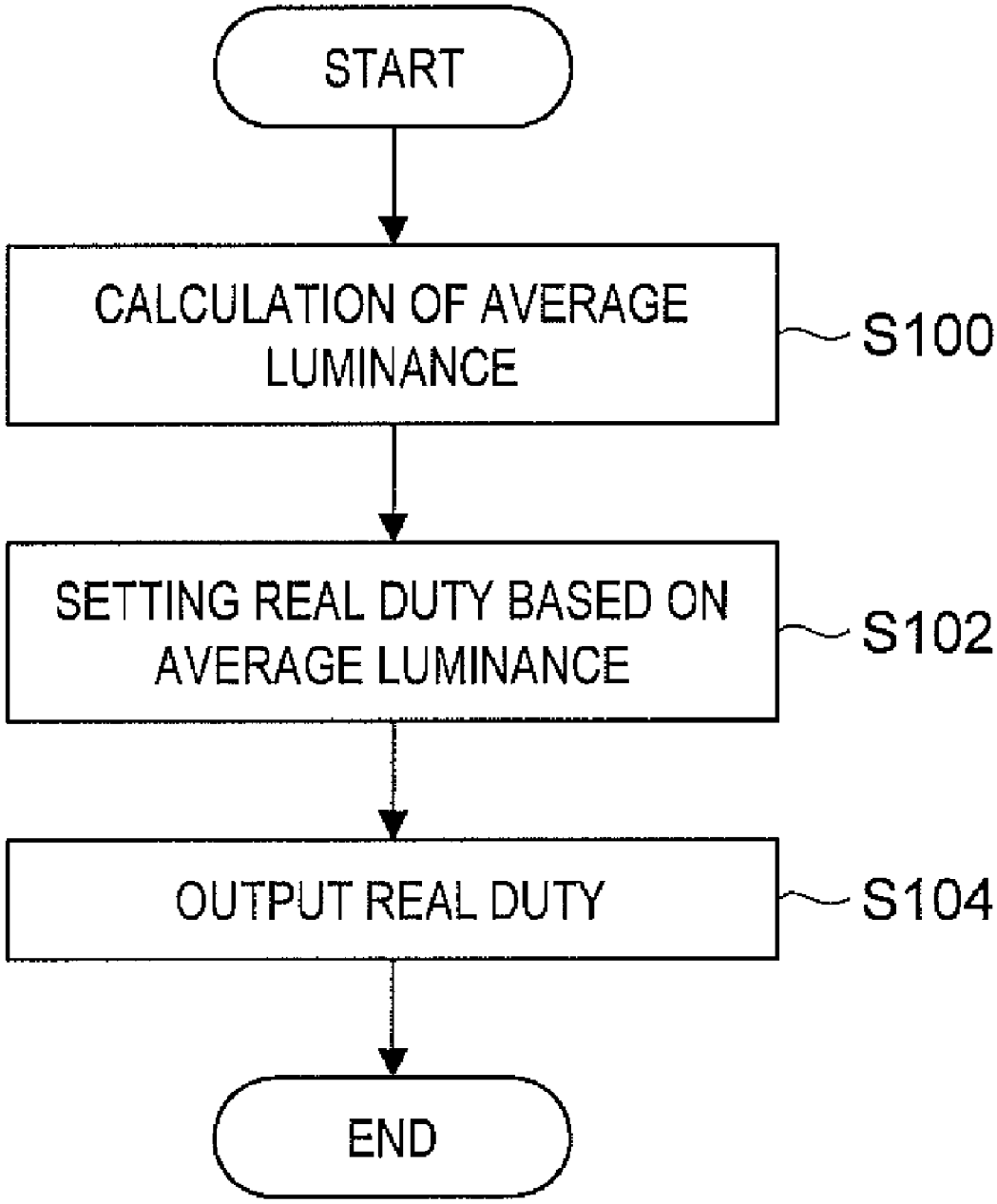
FIG. 7 is a flow chart showing one example of a video-signal processing method according to an embodiment of the present invention.

Then, a video signal processing method according to an embodiment of the present invention will be explained. FIG. 7 is a flow chart showing one example of a video signal processing method according to an embodiment of the present invention, and shows one example of a method for control of light-emitting time during one frame period. Hereafter, explanation will be made, assuming that input video signals are an independent signal to each of R, G, and B colors corresponding to an image every one frame period.

First, an average luminance of a video signal during a predetermined period is calculated from input video signals of R, G, and B (S100). A method for calculating an average luminance at step S100 includes, for example, a method using an arithmetic average, but the invention is not limited to the above-described embodiment. Moreover, the predetermined period can be assumed to be, for example, one frame period.

A real duty is set based on the average luminance calculated at step S100. Setting of a real duty at step S102 can be performed, using a look up table in which for example, a real duty is retained in such a way that a largest light-emitting amount in a standard duty and a light-emitting amount defined by the real duty and the average luminance are the same as each other, and a correspondence between the average luminance and the real duty is established.

The real duty set at step S102 is output (S104). The output of the real duty at step S104 can be performed, for example, every time the real duty is set at step S102. However, the invention is not limited to the above-described embodiment. There can be provided a configuration in which the real duty set at step S102 is retained, and is output in synchronization with each frame period.

As described above, the real duty can be output according to the average luminance during one frame period (predetermined period) of an input video signal according to the video signal processing method according to the embodiment of the present invention, wherein the largest light-emitting amount in the standard duty, and the light-emitting amount defined by the real duty and the average luminance during one frame period (predetermined period) are the same as each other.

Accordingly, an over current can be prevented from flowing in each of pixels (strictly speaking, a light-emitting element included in each of pixels) included on the panel 158 in the display device 100 by using the video signal processing method according to the embodiment of the present invention.

It should be understood by those skilled in the art that various modifications, combinations, sub-combinations and alterations may occur depending on design requirements and other factors insofar as they are within the scope of the appended claims or the equivalents thereof.

Explanation has been made in the display device 100 according to the embodiment of the present invention, assuming, for example, that the input video signal is a digital signal as shown in FIG. 1. However, the invention is not limited to the above form, and a display device according to an embodiment of the present invention is provided with, for example, an analog to digital converter, and there may be provided a configuration in which an input analog signal (video signal) is converted into a digital signal, and the above converted video signal is processed.

The above-described configuration shows one example of an embodiment of the present invention, and, obviously, is within the technical range of the present invention.

What is claimed is:

1. A display device provided with a display portion having (i) a pixel, which has a light-emitting element for self-light emitting according to a current amount and a pixel circuit, which controls a current applied to the light-emitting element according to a voltage signal, (ii) a scanning line supplying a selection signal, by which a pixel to be emitted is selected, to the pixel at a predetermined scanning cycle, and (iii) a data line supplying the voltage signal, which corresponds to an input video signal, to the pixel, the display device comprising:

an average luminance calculation portion that calculates an average luminance of the input video signal during a predetermined period; and a light-emitting time setting portion that sets a real duty defining light-emitting time for light emitting of the light-emitting element every one frame according to the average luminance calculated in the average luminance calculation portion, wherein, the light-emitting time setting portion sets the real duty such that (a) a light-emitting amount defined by a standard duty set beforehand and a maximum luminance of a video signal, and (b) a light-emitting amount defined by the real duty to be set and the average luminance, are the same as each other.

2. The display device according to claim 1, wherein the predetermined period for which the average luminance calculation portion calculates the average luminance is one frame.

3. The display device according to claim 1, wherein the average luminance calculation portion includes:

a current ratio adjustment portion in which a correction value for a primary color signal, based on a voltage-current characteristic, is multiplied for each of primary color signals included in the input video signal; and an average value calculation portion which calculates the average luminance of a video signal output from the current ratio adjustment portion during a predetermined period.

4. The display device according to claim 1, wherein the light-emitting time setting portion retains a look up table that includes correspondences between a luminance of a video signal and a real duty, and the real duty set in the light-emitting time setting portion is set using the look up table as corresponding to the average luminance calculated in the average luminance calculation portion.

5. The display device according to claim 4, wherein:

an upper limit value of the real duty is defined beforehand in the look up table retained in the light-emitting time setting portion, and the real duty set in the light-emitting time setting portion is equal to, or smaller than the upper limit value of the real duty defined beforehand.

6. The display device according to claim 1, further comprising:

a linear conversion portion in which gamma correction of the input video signal is performed for correction to a linear video signal, wherein a video signal input to the average luminance calculation portion is a video signal output from the linear conversion portion.

7. The display device according to claim 1, further comprising:

a gamma conversion portion in which gamma correction of the input video signal is performed according to a gamma characteristic of the display portion.

8. A video signal processing method in a display device provided with a display portion having (i) a pixel, which has a light-emitting element for self-light emitting according to a current amount and a pixel circuit, which controls a current applied to the light-emitting element according to a voltage signal, (ii) a scanning line supplying a selection signal, by which a pixel to be emitted is selected, to the pixel at a predetermined scanning cycle, and (iii) a data line supplying the voltage signal, which corresponds to an input video signal, to the pixel, the video signal processing method comprising the steps of:

calculating an average luminance of the input video signal during a predetermined period; and setting a real duty defining light-emitting time for light emitting of the light-emitting element every one frame according to the average luminance calculated in the calculating step, wherein, the setting step includes setting the real duty such that (a) a light-emitting amount defined by a standard duty set beforehand and a maximum luminance of a video signal, and (b) a light-emitting amount defined by the real duty to be set and the average luminance, are the same as each other.

9. A non-transitory storage medium for use with a display device provided with a display portion having (i) a pixel, which has a light-emitting element for self-light emitting according to a current amount and a pixel circuit, which controls a current applied to the light-emitting element according to a voltage signal, (ii) a scanning line supplying a selection signal, by which a pixel to be emitted is selected, to the pixel at a predetermined scanning cycle, and (iii) a data line supplying the voltage signal, which corresponds to an input video signal, to the pixel, wherein the storage medium has information stored thereon that, when executed by a processing unit in the display device, causes the processing unit to perform the functions of:

calculating an average luminance of the input video signal during a predetermined period; and setting a real duty defining light-emitting time for light emitting of the light-emitting element every one frame according to the calculated average luminance, wherein, setting the real duty includes setting the real duty such that (a) a light-emitting amount defined by a standard duty set beforehand and a maximum luminance of a video signal, and (b) a light-emitting amount defined by the real duty to be set and the calculated average luminance, are the same as each other.

* * * * *